US010890032B2

(12) United States Patent
Taggart

(10) Patent No.: US 10,890,032 B2
(45) Date of Patent: Jan. 12, 2021

(54) METHOD AND SYSTEM FOR STRIPPING TUBULARS AND THE LIKE COMPRISING FRUSTOCONICAL AIR BLADE

(71) Applicant: i3-edge Ltd., Calgary (CA)

(72) Inventor: Mark Taggart, Calgary (CA)

(73) Assignee: 13-Edge, Ltd.

( * ) Notice: Subject to any disclaimer, the term of this patent is extended or adjusted under 35 U.S.C. 154(b) by 3 days.

(21) Appl. No.: 16/312,603

(22) PCT Filed: Jun. 21, 2017

(86) PCT No.: PCT/CA2017/050757
§ 371 (c)(1),
(2) Date: Dec. 21, 2018

(87) PCT Pub. No.: WO2017/219138
PCT Pub. Date: Dec. 28, 2017

(65) Prior Publication Data

US 2019/0255578 A1 Aug. 22, 2019

Related U.S. Application Data

(60) Provisional application No. 62/352,638, filed on Jun. 21, 2016.

(51) Int. Cl.
*E21B 12/06* (2006.01)
*B08B 3/02* (2006.01)
(Continued)

(52) U.S. Cl.
CPC ..... *E21B 12/06* (2013.01); *B08B 3/022* (2013.01); *B08B 5/023* (2013.01); *B08B 9/023* (2013.01);
(Continued)

(58) Field of Classification Search
CPC ..... E21B 33/08; E21B 21/00; E21B 17/006; E21B 37/00; B08B 9/023; B08B 3/022; B08B 5/023
See application file for complete search history.

(56) References Cited

U.S. PATENT DOCUMENTS 3,924,696 A * 12/1975 Horlin ..... B23Q 11/0046 175/209
5,067,655 A 11/1991 Farago et al.
(Continued)

FOREIGN PATENT DOCUMENTS

CN 201728208 U 2/2011
CN 204804700 U 11/2015
(Continued)

OTHER PUBLICATIONS

Canadian Intellectual Property Office, International Search Report, PCT/CA2017/050757, dated Sep. 6, 2017.
(Continued)

*Primary Examiner* — Nicole Coy
(74) *Attorney, Agent, or Firm* — Scott T. Griggs; Griggs Bergen LLP

(57) ABSTRACT

A toroidal air blade tool for mounting on top of a blow-out preventer is provided. The tool can include upper and lower toroidal ring halves that form a plenum and a circumferential orifice when assembled together. Compressed gas or pressurized fluid introduced into the plenum exits the orifice in the form of frustoconical gas or fluid blade that can strip off mud and produced substances from tubulars being removed from a well.

8 Claims, 6 Drawing Sheets

(51) Int. Cl.

| | |
|---|---|
| ***B08B 5/02*** | (2006.01) |
| ***B08B 9/023*** | (2006.01) |
| ***E21B 33/08*** | (2006.01) |
| ***E21B 21/00*** | (2006.01) |
| ***E21B 17/00*** | (2006.01) |
| ***E21B 37/00*** | (2006.01) |

(52) U.S. Cl.
CPC ..... *E21B 17/006* (2013.01); *E21B 21/00* (2013.01); *E21B 33/08* (2013.01); *E21B 37/00* (2013.01)

(56) References Cited

U.S. PATENT DOCUMENTS 5,101,896 A * 4/1992 Thompson ..... E21B 33/08 166/311
8,443,893 B1 * 5/2013 Finger ..... E21B 41/0078 134/199
9,404,313 B2 * 8/2016 Hefner ..... E21B 17/006
9,415,426 B1 * 8/2016 Blake ..... B08B 3/024
2010/0294314 A1 11/2010 Daleside
2014/0262298 A1 9/2014 Hefner et al.

FOREIGN PATENT DOCUMENTS

WO 9960245 A1 11/1999
WO 2011113032 A2 9/2011

OTHER PUBLICATIONS

Canadian Intellectual Property Office, Written Opinion of the International Searching Authority, PCT/CA2017/050757, dated Sep. 8, 2017.

* cited by examiner

METHOD AND SYSTEM FOR STRIPPING TUBULARS AND THE LIKE COMPRISING FRUSTOCONICAL AIR BLADE

CROSS-REFERENCE TO RELATED APPLICATIONS

This application is the National Stage of, and therefore, claims the benefit of co-pending International Application No. PCT/CA2017/050757 filed Jun. 21, 2017; which claims priority of U.S. provisional patent application Ser. No. 62/352,638 filed Jun. 21, 2016; both of which are incorporated by reference into this application in their entirety.

TECHNICAL FIELD

The present disclosure is related to the field of systems and techniques for stripping mud and produced substances from tubulars being withdrawn from a well, in particular, air blade tools for stripping mud and produced substances from tubulars.

BACKGROUND

When pipe, tubing and bottom hole assemblies ("BHA") are tripped out of a well, they are often covered in mud and produced substances, which need to be stripped off after being tripped out so they can be racked for use again. Conventional pipe strippers can include toroidal rubber rings mounted above the blow-out preventer ("BOP") that can strip off mud and substances in a squeegee-like action as the tubular is pulled through the rubber ring as the tubular is being tripped out. The problem with these type of pipe strippers is that tubular tool joints and BHAs are larger in diameter than the tubulars. While the tubular tool joints can be slowly pulled through conventional rubber ring pipe strippers, BHAs cannot due to their larger diameter. Thus, the rubber ring needs to be removed from the wellhead before the BHA can be pulled up through rig floor and removed from the well. This adds unnecessary time and expense to the operation.

It is, therefore, desirable to provide a tubular stripping tool for stripping mud and produced substances that can accommodate BHAs to pass through the stripping tool without having to disassemble and remove the stripper tool from the wellhead.

SUMMARY

An apparatus is provided for stripping mud and produced substances from pipe, tubulars, tubular pipe joints and BHAs (collectively referred to as "tubulars" for the purposes of this specification and the claims herein) being tripped out of a well using a stream of compressed gas (such as air or an inert gas), fluid or a combination thereof in the form of a frustoconical-shaped "air blade". In some embodiments, an air blade stripping tool can comprise a toroidal ring structure placed on top of a BOP, or at some other logical location on a wellhead, as obvious to those skilled in the art. The ring structure can have the same internal diameter of the BOP so that any tubular or BHA that can pass through the BOP can pass through the air blade stripping tool without any disassembly of the tool.

Broadly stated, in some embodiments, a method can be provided for removing mud and produced substances from a well, the method comprising the step of forming a frustoconical-shaped air blade about a tubular being removed from the well, the air blade comprised of a stream of compressed air configured for removing at least some of the mud and produced substances from the tubular.

Broadly stated, in some embodiments, the method can further comprise the step of mixing a solvent with the compressed air.

Broadly stated, in some embodiments, the method can further comprise the step of mixing a rust inhibitor with the compressed air.

Broadly stated, in some embodiments, a method can be provided for removing mud and produced substances from tubulars being removed from a well, the method comprising the steps of: forming a first frustoconical-shaped air blade about a tubular being removed from the well, the first air blade comprised of a first stream of compressed air mixed with a solvent, the first stream configured for removing at least some of the mud and produced substances from the tubular as it is being removed from the well; and forming a second frustoconical-shaped air blade about the tubular, the second air blade disposed above the first air blade, the second air blade comprised of a second stream of compressed air, the second stream configured for drying the tubular after passing through the first stream.

Broadly stated, in some embodiments, the method can further comprise the step of forming a third frustoconical-shaped air blade about the tubular, the third air blade disposed above the second air blade, the third air blade comprised of a third stream of compressed air mixed with a rust inhibitor, the third stream configured for applying the rust inhibitor to the tubular after passing through the first and second streams.

Broadly stated, in some embodiments, a method can be provided for removing mud and produced substances from tubulars being removed from a well, the method comprising the steps of: forming a frustoconical-shaped wash blade about a tubular being removed from the well, the wash blade comprised of pressurized drilling mud, whereby the wash blade maintains a continuous kill displacement in the well as the tubular is being removed from well while simultaneously removing at least some of the mud and produced substances from the tubular; forming a first frustoconical-shaped air blade about the tubular, the first air blade disposed above the wash blade, the first air blade comprised of a first stream of compressed gas mixed with a solvent, the first air blade configured for removing the mud, the produced substances and the drilling mud from the tubular after passing through the wash blade; and forming a second frustoconical-shaped air blade about the tubular, the second air blade disposed above the first air blade, the second air blade comprised of a second stream of compressed gas, the second air blade configured for drying the tubular after passing through the first air blade.

Broadly stated, in some embodiments, a rust inhibitor can be mixed with the second stream of compressed gas, wherein the rust inhibitor can be applied to the tubular after passing through the wash blade and the first air blade.

Broadly stated, in some embodiments, an apparatus can be provided for stripping mud and produced substances from a tubular being removed from a well, the apparatus comprising: a toroidal upper ring half defining an interior passageway therethrough; a toroidal lower ring half configured to mate with the upper ring half, the combination of the upper and lower ring halves further configured to form a plenum therebetween, the combination further configured to form an orifice disposed at least partially around a circumference of the passageway; and at least one inlet disposed through a sidewall of one of the upper and lower ring halves configured to provide communication to the plenum.

Broadly stated, in some embodiments, the at least one inlet can be disposed through the upper ring half.

Broadly stated, in some embodiments, the apparatus can further comprise at least one vane disposed in the plenum.

Broadly stated, in some embodiments, the at least one vane can be disposed on the upper ring half.

Broadly stated, in some embodiments, the at least one of the at least one vane can be angled to direct or deflect gas or fluid flowing through the orifice into the passageway, wherein the flowing gas or fluid forms a vortex.

Broadly stated, in some embodiments, the lower ring half can further comprise a convex lip surface curving downwardly from the plenum towards the passageway, the convex lip surface configured to provide a Coandă effect on gas or fluid flowing through the orifice.

Broadly stated, in some embodiments, the apparatus can further comprise a manifold operatively coupled to the at least one inlet.

Broadly stated, in some embodiments, the apparatus can further comprise a hose operatively coupled to the manifold.

Broadly stated, in some embodiments, the apparatus can further comprise at least one shim configured for fitment between the upper and lower ring halves for adjusting the height of the orifice.

Broadly stated, in some embodiments, the apparatus can further comprise a shim configured for fitment between the upper and lower rings for adjusting the size of the orifice.

DETAILED DESCRIPTION OF EMBODIMENTS

Figure 1:
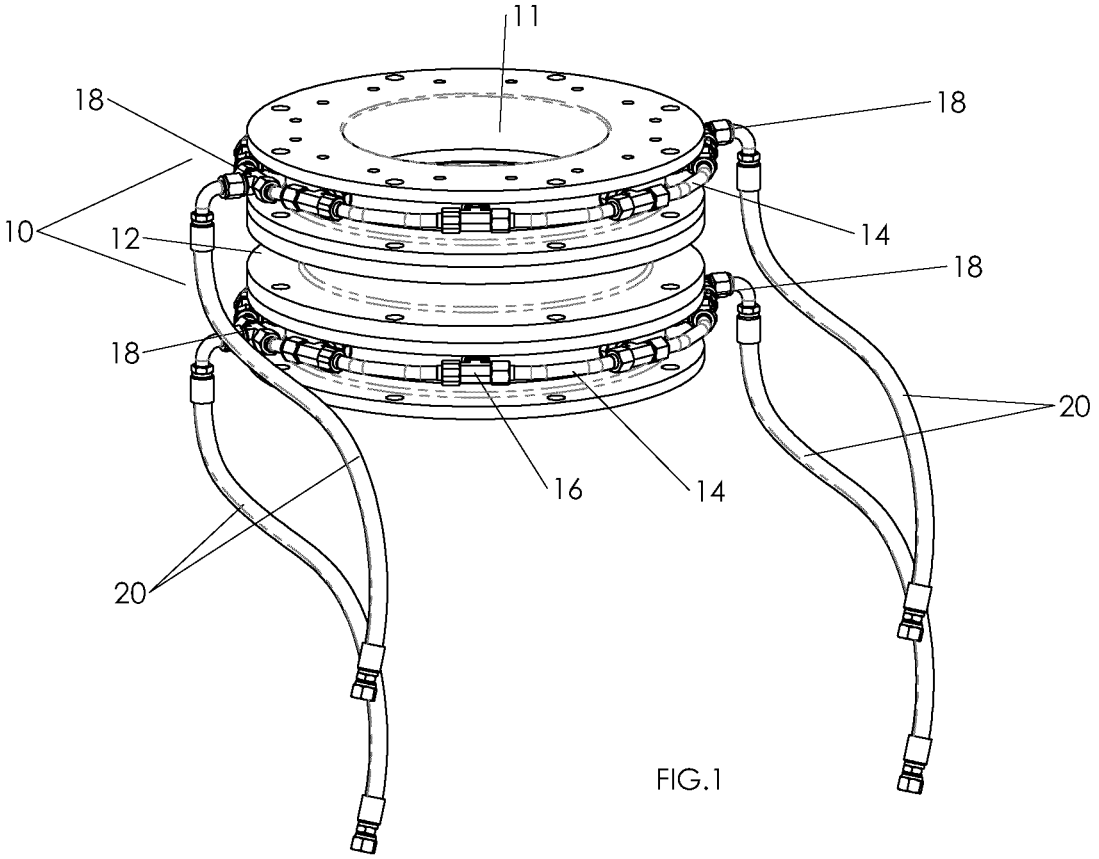
FIG. 1 is a perspective view depicting one embodiment of an air blade tool for stripper tubulars.

Referring to FIGS. 1 to 4, 7 and 12, one embodiment of air blade ring 10 is shown. In some embodiments, air blade ring 10 can comprise upper ring half 22 and lower ring half 24 defining passageway 11 therethrough, the combination of upper and lower ring halves 22 and 24 configured to form plenum 28 therebetween and orifice 30 disposed circumferentially around passageway 11 between upper and lower ring halves 22 and 24. In some embodiments, passageway 11 can comprise the same diameter of the BOP so that BHAs can pass through the BOP without removing air blade rings 10.

In some embodiments, one or more of shim 23 can be disposed between ring halves 22 and 24 to adjust the height of orifice 30. In some embodiments, each shim 23 can comprise a thickness ranging from about 0.001" to about 0.030" or more, wherein a desired thickness can be achieved by combining two more shims 23 of varying thicknesses together. In some embodiments, shim 23 can be comprised of one or more of brass, stainless steel, plastic and any other suitable shim material, as well known to those skilled in the art.

In some embodiments, upper and lower ring halves 22 and 24 can be manufactured with zero clearance between them, +/−0.0005", when combined together so that the height of orifice 30 can be set solely by the thickness of shim 23 placed between upper and lower ring halves 22 and 24. In other embodiments, upper and lower ring halves 22 and 24 can be manufactured with a predetermined clearance between them to provide a minimum height for orifice 30 when combined together. The determination and selection of the height of orifice 30 can be dictated by the type of gas or fluid to be passed through air blade ring 10, as determined by those skilled in the art. In representative embodiments, the height of orifice 30 can range from about 0.010" to 0.030", although the height of orifice 30 can be selected outside of this range, as required and as determined by those skilled in the art. For example, a narrower dimension for orifice 30 can be selected when passing air or other gases through air blade ring 10, a wider dimension for orifice 30 can be selected when passing more viscous liquids such as drilling mud through air blade ring 10, while an intermediate dimension between the narrow and wide dimensions discussed above can be selected when passing less viscous liquids such as solvents or rust inhibitors through air blade ring 10.

Figure 9:
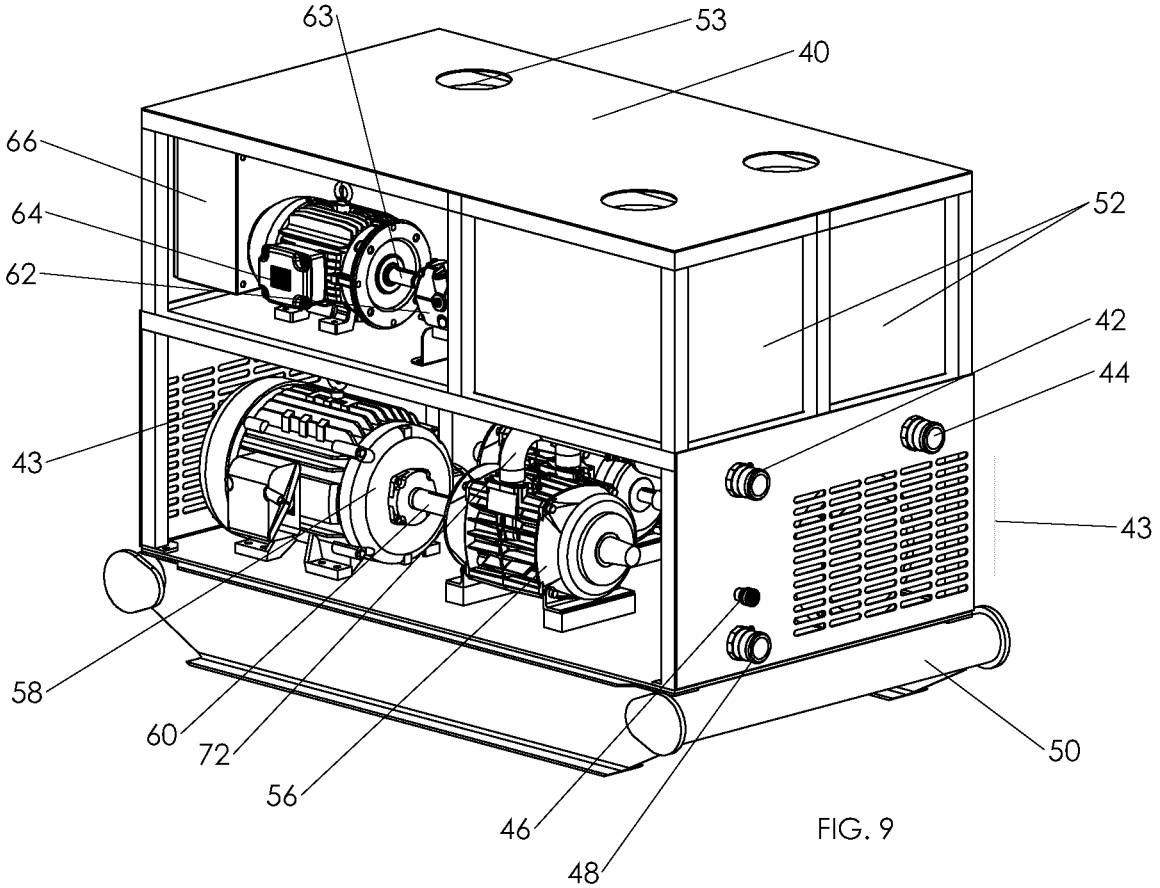
FIG. 9 is a left-side perspective view depicting the air compressor unit of FIG. 8 with the left-side cover removed.
Figure 10:
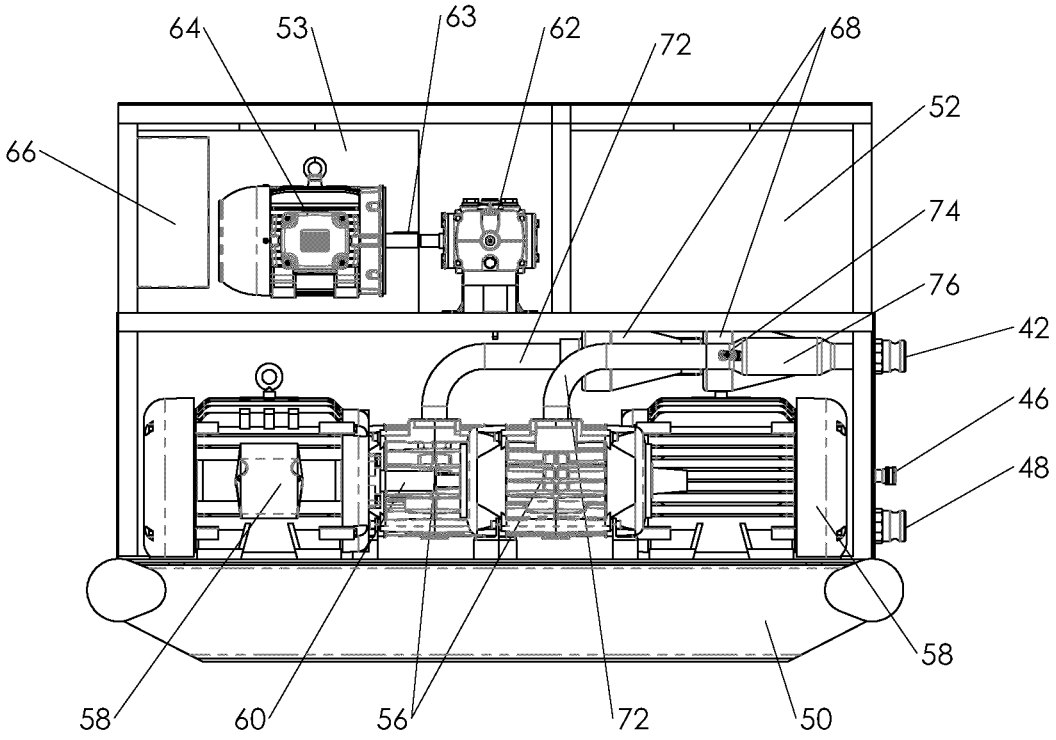
FIG. 10 is a left-side elevation view depicting the air compressor unit of FIG. 8 with the left-side cover removed.
Figure 11:
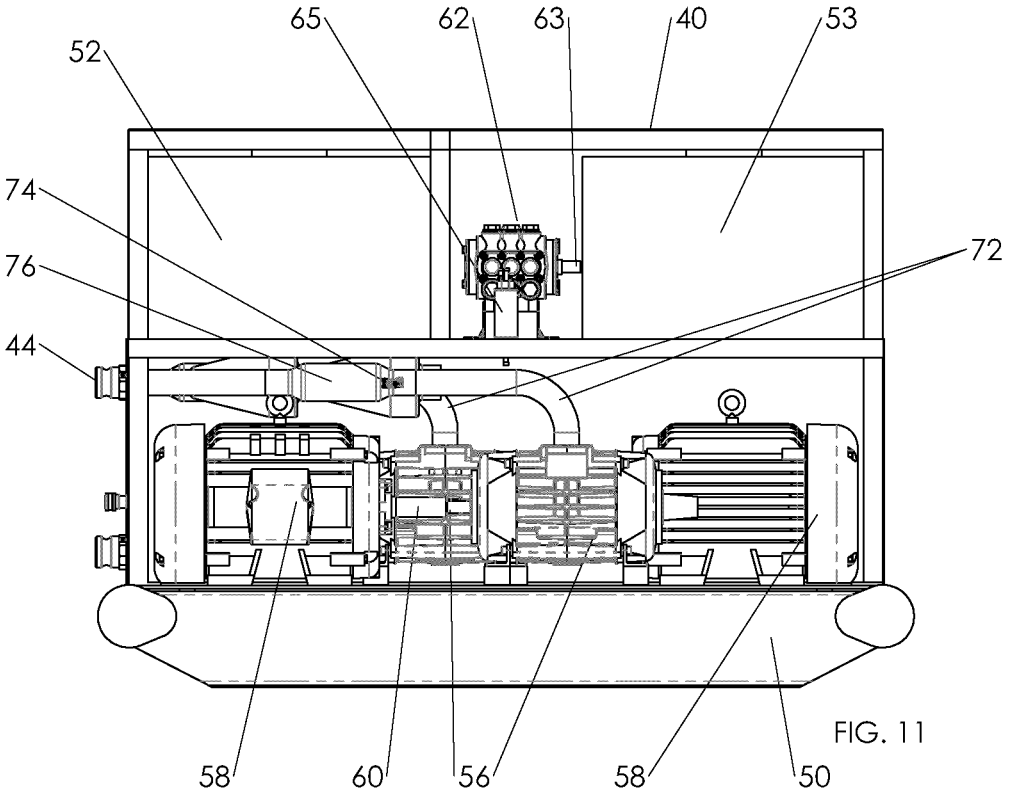
FIG. 11 is a right-side elevation view depicting the air compressor unit of FIG. 8 with the right-side cover removed.
Figure 12:
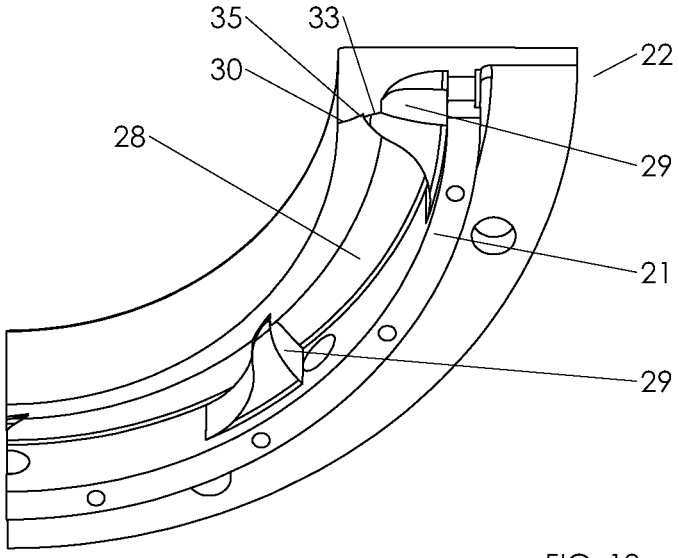
FIG. 12 is a perspective cut-away view depicting the air blade tool of FIG. 4.

In some embodiments, air blade ring 10, can comprise at least one inlet 26 to provide communication to plenum 28. In some embodiments, air blade ring 10 can comprise coupler 16 disposed in each of at least one inlet 26. In some embodiments, air blade ring 10 can comprise manifold 14 further comprising one or more coupler 18 configured for coupling to air hose 20, which can be further coupled to air compressor unit 40 (as shown in FIGS. 9 to 11), as well known to those skilled in the art, to provide a source of compressed air. In some embodiments, orifice 30 can be bounded from above by surface 25 on upper ring half 22, and from below by surface 27 on lower ring half 24. Lower ring half 24 can further comprise lip surface 31 extending inwardly towards passageway 11 from upper ring half 22. In some embodiments, lip surface 31 can comprise a convex cross-section profile, curving downwardly towards passageway 11 from plenum 28. In this configuration, lip surface 31 can provide a "Coandă" effect, as known to those skilled in the art, on gas or fluid flowing from plenum 28 through orifice 30 into passageway 11 to follow the curve along the convex profiled surface of lip surface 31. In so doing, the efficacy of the flowing gas or fluid to strip mud and produced substances from tubulars as they are removed from a well can be increased. In some embodiments, surface 25 can further comprise step profile 33 disposed thereon to form notch 35 that can act to form a low pressure region therein to further enhance the Coandă effect as gas or fluid flows through orifice 30 along lip surface 31 into passageway 11.

Figure 7:
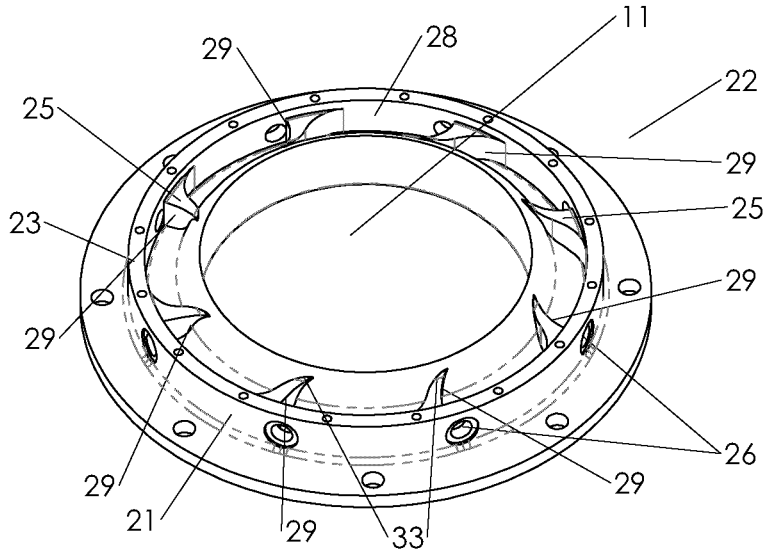
FIG. 7 is a bottom perspective view depicting the upper ring half (22) of FIG. 4.
Figure 8:
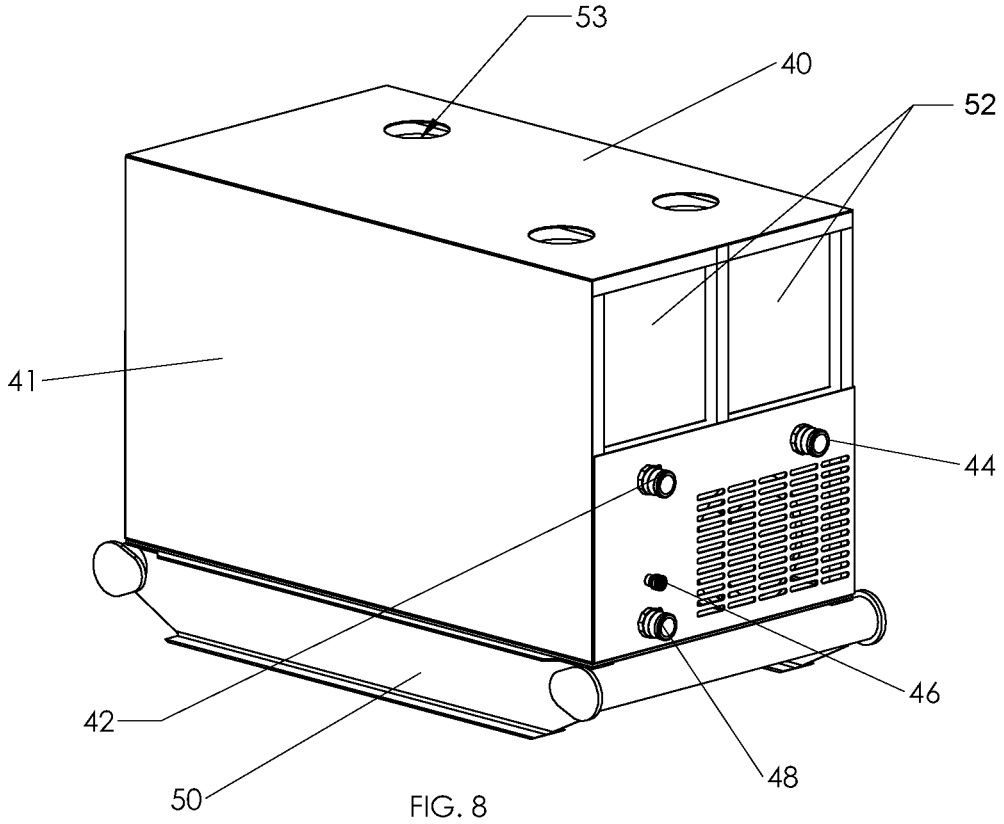
FIG. 8 is a left-side perspective view depicting a skid-mounted air compressor unit for use with the air blade tool of FIG. 1.

Referring to FIG. 7, upper ring half 22 can comprise at least one vanes 29 disposed therein, pointing towards passageway 11. In some embodiments, one or more of vanes 29 can be angled relative to sidewall 21 of upper ring half 22. In this configuration, the angling of vanes 29 can direct or deflect gas or fluid flowing through orifice 30 into passageway 11 in a spiraling manner to form a vortex, which can further enhance to strip mud or produced substances from tubulars being removed from a well.

Figure 3:
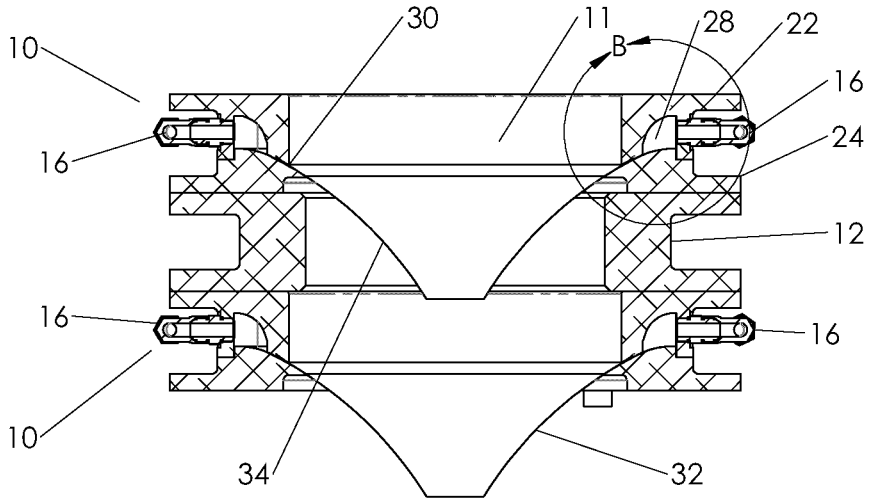
FIG. 3 is a side elevation cross-section view depicting the air blade tool of FIG. 2 along section lines A-A.
Figure 4:
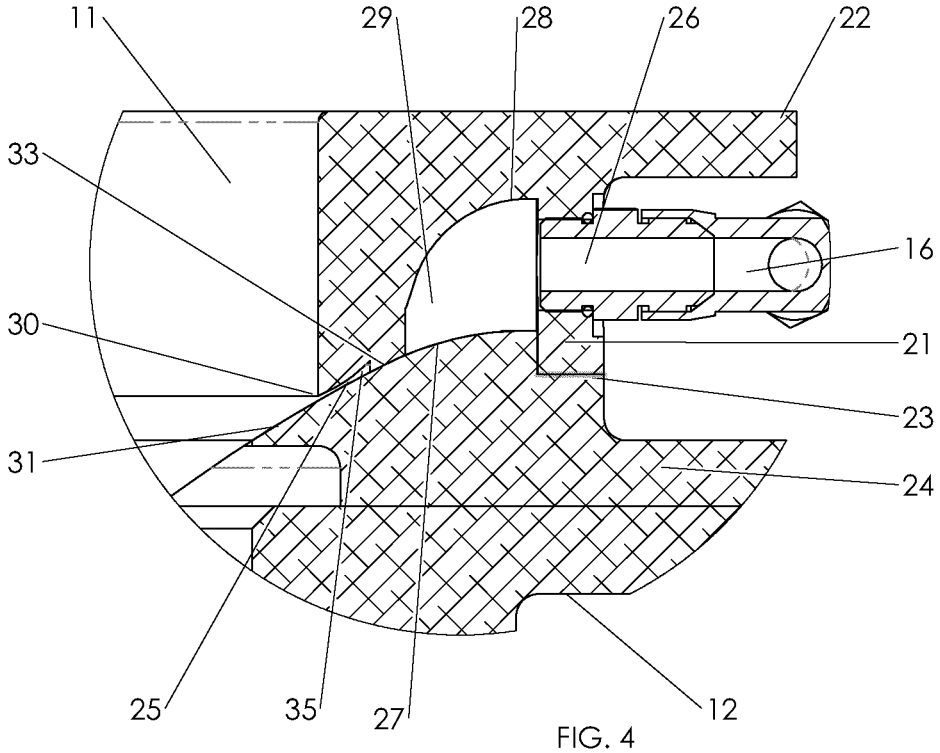
FIG. 4 is a side elevation cross-section view depicting detail B of the air blade tool of FIG. 3.
Figure 5:
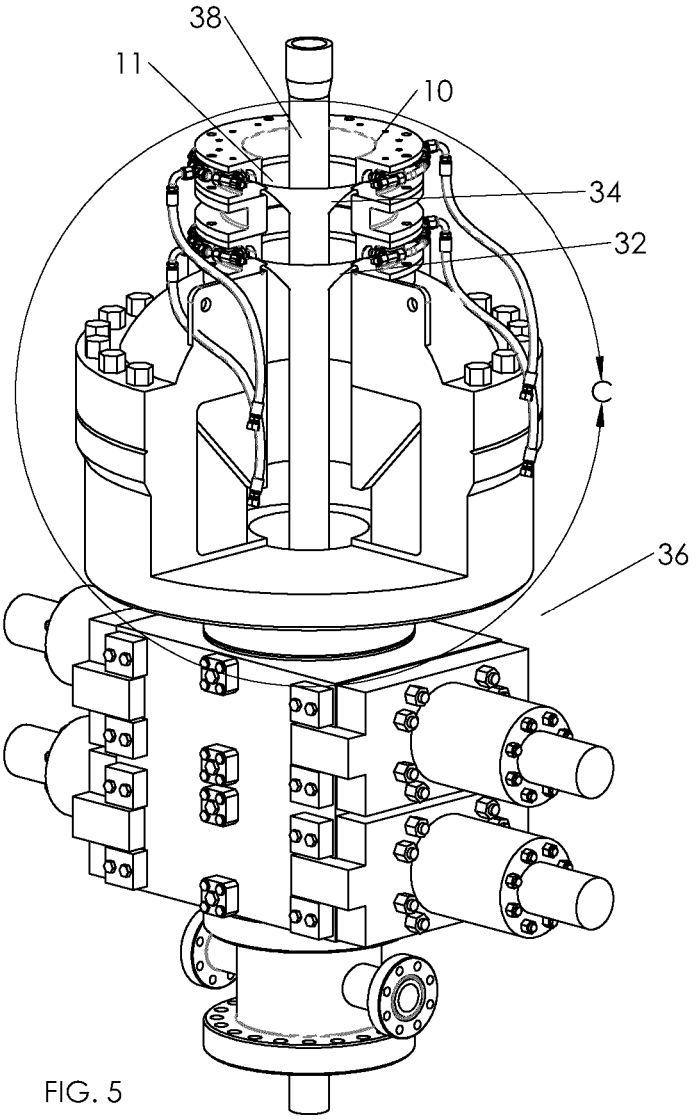
FIG. 5 is a perspective view depicting the air blade tool of FIG. 1 mounted on a BOP, with a portion thereof shown in a cut-away view.
Figure 6:
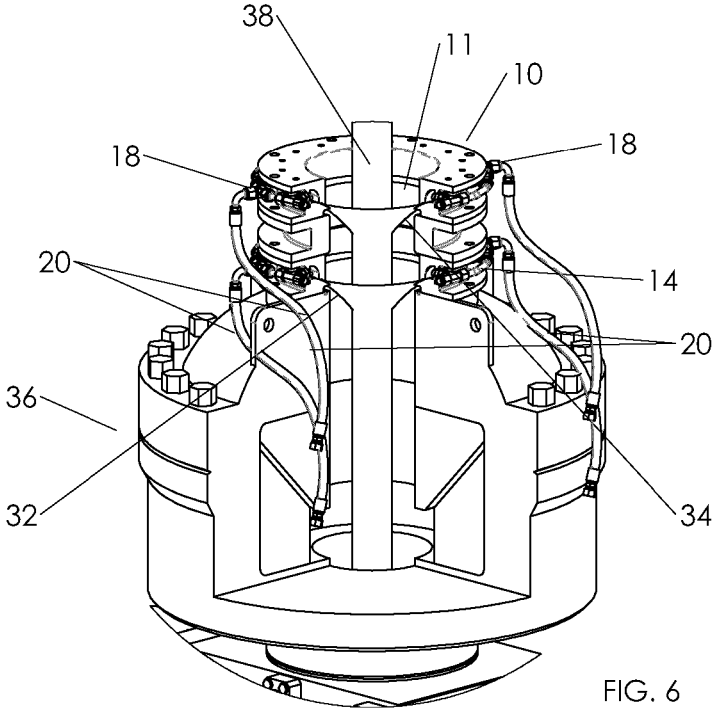
FIG. 6 is a perspective cut-away view depicting detail C of the air blade tool of FIG. 5.

Referring to FIG. 3, in some embodiments, two air blade rings 10 can be stacked together with spacer ring 12 disposed therebetween. In some embodiments, lower air blade ring 10 can form first frustoconical air blade 32, and upper air blade ring 10 can form second frustoconical air blade 34. Referring to FIGS. 5 and 6, a pair of air blade rings 10 is shown mounted on top of BOP 36 with tubular 38 being removed through passageway 11.

In some embodiments, air blade 32 can be comprised of compressed air and a solvent configured for removing mud and produced substances from tubular 38 as it is being removed through passageway 11. In some embodiments, air blade 34 can be comprised of compressed air to dry tubular 38 after passing through air blade 32. In other embodiments, a third air blade ring 10 can be disposed above air blade rings 10 to produce a third air blade comprised of compressed air and a rust inhibitor to apply rust inhibitor to tubular 38 after passing through the first two air blades 32 as it passes through passageway 11.

In some embodiments, air blade ring 10 can be used to dispense steam to remove ice and debris from tubular 38 in winter conditions.

In some embodiments, a mixer (as described below) can be used to mix chemicals with the compressed air, such as solvents or rust inhibitors, before the compressed air is injected into plenum 28 of air blade ring 10 through hose 20, coupler 18, manifold 14 and coupler 16. In other embodiments, manifold 14 can comprise further couplers 18 operatively coupled to a source of pressured solvent or rust inhibitor wherein the solvent or rust inhibit can be injected into manifold 14 for mixing with the compressed air in manifold 14 and/or in plenum 28.

In some embodiments, air blade ring 10 can be comprised of aluminum, stainless steel or any other metal, metal alloy or other material suitable for use on a wellhead, as well known to those skilled in the art.

Referring to FIGS. 8 to 11, one embodiment of air compressor unit 40 for use with air blade 10 is shown. In some embodiments, air compressor unit 40 can comprise one or more vane compressors 56 driven by electric motors 58 via motor shafts 60, wherein each vane compressor can provide compressed air to a single air blade 10 via an air connection, shown as connector 42 or connector 44 in the figures. In some embodiments, vane compressor 56 can comprise a model GD150 compressor as manufactured by Gardener Denver, Inc. of Milwaukee, Wis., USA. In some embodiments, electric motor 58 can comprise a model 254 TEFC 15 HP motor as manufactured by WEG S.A. of Santa Catarina, Brazil. In some embodiments, air compressor unit 40 can further comprise triplex pump 62 powered by electric motor 64 via motor shaft 63 for pumping mud supplied from a mud tank (not shown) in through inlet connector 48, and back out through outlet connector 46 to be further coupled to an air blade 10 as a means to pump mud into a well as tubulars are being tripped out of the well to maintain a continuous kill displacement in the well, as well known to those skilled in the art. In some embodiments, triplex pump 62 can comprise a model 7CP6111 pump as manufactured by Cat Pumps, a division of Diversified Dynamics Corp. of Minneapolis, Minn., USA.

In some embodiments, electric motor 64 can comprise a model 187TEFC motor as manufactured by WEG S.A. of Santa Catarina, Brazil. In so doing, the pressurized mud injected into the well through air blade 10 can provide a washing effect on the tubulars being tripped out.

Figure 2:
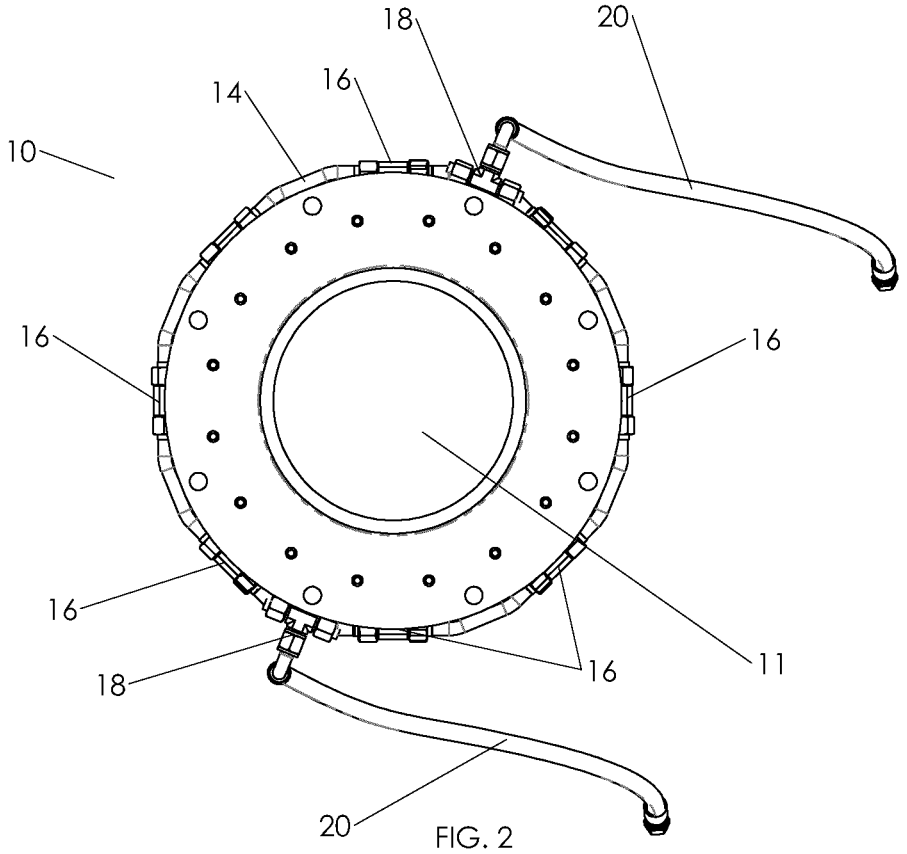
FIG. 2 is a top plan view depicting the air blade tool of FIG. 1.

As shown in FIGS. 1 and 2, each air blade 10 has two air hoses 20 as a means for supplying compressed air or pressurized fluid thereto. A hose (not shown) can be used to couple air compressor unit 40 to an air blade 10 from connectors 42, 44 or 46, as the case may be, via a Y-coupler or manifold (not shown), as well known to those skilled in the art.

In some embodiments, each vane compressor 56 can be supplied air through cone intake air filter 68, which can draw from atmospheric air entering into air compressor unit 40 through grates 43 disposed on end walls thereof. Compressed air exiting vane compressor 56 can pass through outlet manifold 72 coupled to atomizer manifold 76 before passing through connector 42 or 44, as the case may be. In some embodiments, atomizer manifold 76 can further comprise fluid injector 74 to enable fluids to be injected and then atomized and mixed with compressed air within atomizer manifold 76, fluids such as solvents or rust inhibitors as discussed above. In some embodiments, air compressor unit 40 can further comprise injection pump 65 operatively coupled to solvent tank or tanks 52 and rust inhibitor tank 53 to pump solvent or rust inhibitor therefrom to fluid injector 74. In some embodiments, injection pump 65 can comprise a 5 gallon per minute pump as manufactured by Accel Performance Group LLC of Cleveland, Ohio, USA.

In some embodiments, three air blades 10 can be stacked one on top of another on a BOP. The first air blade 10, or lowest on the stack closest to the BOP, can be configured to have pressurized drilling mud pumped through it to form a frustoconical-shaped fluid or wash blade to clean off mud and produced substances off of tubulars, tool joints and BHAs being tripped out of a well while, at the same time, injecting drilling mud into the well to maintain a continuous kill displacement, as described above and as well-known to those skilled in the art. The second air blade 10 can be mounted above the first air blade and can be further configured to have compressed air mixed with a solvent and/or rust inhibitor pumped through it to form a frustoconical-shaped air blade to wash off any remaining mud or produced substances on the tubulars, tool joints and BHAs being tripped out. The third air blade can be mounted above the second air blade and can be further configured to have just compressed air pumped through it to form a frustoconical-shaped air blade to dry off the tubulars, tool joints and BHAs after passing through the first two air blades.

In some embodiments, air compressor unit 40 can comprise control panel 66 further comprising electrical components and switchgear for the operation of the electric motors and pumps disposed in air compressor unit 40, as well known to those skilled in the art. For illustrative purposes only, the internal electrical connections and plumbing connections for compressed air and fluids have not been included in FIGS. 8 to 11 to better illustrate the main componentry disposed in air compressor unit 40. These internal electrical and plumbing connections are well known to those skilled in the art.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

I claim:

1. An apparatus for stripping mud and produced substances from a tubular being removed from a well, the apparatus comprising:

a) a toroidal upper ring half defining an interior passageway therethrough;

b) a toroidal lower ring half configured to mate with the upper ring half, the combination of the upper and lower ring halves further configured to form a plenum therebetween, the combination further configured to form an orifice disposed at least partially around a circumference of the passageway, wherein the lower ring half further comprises a convex lip surface curving downwardly from the plenum towards the passageway, the convex lip surface configured to provide a Coandă effect on gas or fluid flowing through the orifice;

c) at least one inlet disposed through a sidewall of one of the upper and lower ring halves configured to provide communication to the plenum; and d) at least one shim configured for fitment between the upper and lower ring halves for adjusting the height of the orifice.

2. The apparatus as set forth in claim 1, wherein the at least one inlet is disposed through the upper ring half.

3. The apparatus as set forth in claim 1, wherein the apparatus further comprises at least one vane disposed in the plenum.

4. The apparatus as set forth in claim 3, wherein the at least one vane is disposed on the upper ring half.

5. The apparatus as set forth in claim 3, wherein at least one of the at least one vane is angled to direct or deflect gas or fluid flowing through the orifice into the passageway, wherein the flowing gas or fluid forms a vortex.

6. The apparatus as set forth in claim 1, further comprising a manifold operatively coupled to the at least one inlet.

7. The apparatus as set forth in claim 6, further comprising a hose operatively coupled to the manifold.

8. The apparatus as set forth in claim 1, wherein the upper ring half further comprises a step profile to form a notch when the upper ring half is mated to the lower ring half, the notch configured to form a low pressure region to enhance the Coandă effect.

* * * * *